US005369224A

United States Patent [19]

Miyata

[11] Patent Number: 5,369,224

[45] Date of Patent: Nov. 29, 1994

[54] ELECTRONIC MUSICAL INSTRUMENT PRODUCING PITCH-DEPENDENT STEREO SOUND

[75] Inventor: Tomomi Miyata, Hamamatsu, Japan

[73] Assignee: Yamaha Corporation, Hamamatsu, Japan

[21] Appl. No.: 80,408

[22] Filed: Jun. 18, 1993

[30] Foreign Application Priority Data

Jul. 1, 1992 [JP] Japan ..... 4-174182

[51] Int. Cl.[5] ..... G10H 1/02

[52] U.S. Cl. ..... 84/662; 84/DIG. 1; 84/DIG. 27

[58] Field of Search ..... 84/DIG. 1, DIG. 20, 84/DIG. 27, DIG. 26, 659, 661, 662, DIG. 2, 17, 618, 656; 381/63, 64; 369/87

[56] References Cited

U.S. PATENT DOCUMENTS

| | | | |
|---|---|---|---|
| 4,188,504 | 2/1980 | Kasuga et al. . | |
| 4,219,696 | 8/1980 | Kogure et al. . | |
| 4,275,267 | 3/1981 | Kurtin . | |
| 4,308,424 | 12/1981 | Bice, Jr. | 369/87 |
| 4,410,761 | 10/1983 | Schickedanz . | |
| 4,577,540 | 3/1986 | Yamana . | |
| 4,625,326 | 11/1986 | Kitzen et al. . | |
| 4,648,116 | 3/1987 | Joshua . | |
| 4,653,096 | 3/1987 | Yokoyama | 381/17 |
| 4,731,848 | 3/1988 | Kendall et al. . | |
| 4,817,149 | 3/1989 | Myers . | |
| 4,893,120 | 1/1990 | Doering et al. . | |
| 5,027,589 | 3/1992 | Fujimori . | |
| 5,027,687 | 7/1991 | Iwamatsu . | |
| 5,040,220 | 8/1991 | Iwamatsu | 381/63 |
| 5,046,097 | 9/1991 | Lowe et al. . | |
| 5,099,739 | 3/1992 | Adachi . | |
| 5,105,462 | 4/1992 | Lowe et al. . | |
| 5,142,586 | 8/1992 | Berkhout . | |
| 5,164,840 | 11/1992 | Kawamura et al. . | |
| 5,198,604 | 3/1993 | Higashi et al. | 84/662 |
| 5,208,860 | 5/1993 | Lowe et al. | 381/17 |
| 5,256,830 | 10/1993 | Takeuchi et al. | 84/DIG. 26 |

FOREIGN PATENT DOCUMENTS

| | | |
|---|---|---|
| 58-16099 | 9/1983 | Japan . |
| 60-75887 | 4/1985 | Japan . |
| 61-49397 | 4/1986 | Japan . |

OTHER PUBLICATIONS

Jens Blauert, translated by John S. Allen, "Spatial hearing: The Psychophysics of Hyman Sound Localization" The MIT Press, New material and English translation 1983, pp. 85–93.

Sakamoto, Gotoh, Kogure, and Shimbo, "Controlling Sound Image Localization in Stereo Reproduction," *J. Audio Eng. So.*, vol. 29, Nov. 1981 at 794.

Sakamoto, Gotoh, Kogure, and Shimbo, "Controlling Sound Image Localization in Stereo Reproduction: Part II," *J. Audio Eng. So.*, vol. 30, Oct. 1982 at 719.

*Primary Examiner*—Stanley J. Witkowski

*Attorney, Agent, or Firm*—Spensley Horn Hubas & Lubitz

[57] ABSTRACT

An electronic musical instrument is provided with an input implement for inputting performance information which designates a tone pitch of a musical sound to be produced during the course of performance. A tone generator of a monaural type generates a monaural tone signal having the designated tone pitch. A distributing circuit is connected to the tone generator for distributing the monaural tone signal selectively to a plurality of range channels assigned to different tone pitch ranges. A plurality of acoustic image formers are provided in the respective range channels for processing the distributed monaural tone signal to impart thereto stereophonic spread and location in different manners associated to the different tone pitch ranges. A stereo sound system is connected to the range channels for producing the musical sound having the imparted stereophonic spread and location.

20 Claims, 6 Drawing Sheets

Channel assigment table

| Key code | 21 | 22 | 23 | 24 | ---------- | 70 | 71 | ---------- |
|---|---|---|---|---|---|---|---|---|
| Range channel | 1 | 1 | 1 | 1 | ---------- | 4 | 4 | ---------- |

ELECTRONIC MUSICAL INSTRUMENT PRODUCING PITCH-DEPENDENT STEREO SOUND

BACKGROUND OF THE INVENTION

The present invention relates to an electronic musical instrument having a stereophonic function to impart an acoustic image to a produced musical sound.

Conventionally, one type of electronic musical instrument having the stereophonic function utilizes a stereo tone generator which undergoes stereo sampling of a waveform for obtaining stereophonic location and wideness of an acoustic image dependent on a tone pitch. For this, the stereo tone generator stores a pair of waveforms for an individual musical tone, thereby requiring a relatively large capacity waveform memory. Another type of conventional electronic musical instrument, such as an electronic piano of moderate price utilizes a monaural tone generator which stores a single tone waveform, while a pseudo-stereo circuit such as a comb filter circuit is adapted to process the generated monaural tone signal to impart thereto stereophonic wideness or spread of an acoustic image. However, the obtained acoustic image is rather monotonous in that the spread and location of the acoustic image is uniform for different tone pitches, thereby disadvantageously producing an unnatural sound. In contrast, an acoustic piano generates in a left zone a relatively low pitch tone which is resonated by a vibration plate to thereby emit a spread piano sound. Further, a relatively high pitch tone is generated in a right zone of the acoustic piano, and is directly emitted to dominate the resulting piano sound. Therefore, the high pitch piano sound has a definite location originating from the right zone of the piano. In contrast, the conventional electronic musical instrument having the monaural tone generator has a drawback that such a realistic acoustic field of a natural piano instrument cannot be realized.

SUMMARY OF THE INVENTION

In view of the above noted drawback of the prior art, an object of the present invention is to improve stereophonic production of a musical sound by varying the spread and location of an acoustic image for different tone pitch ranges. According to the invention, the electronic musical instrument comprises input means for inputting performance information which designates a tone pitch of a musical sound to be produced during the course of performance, tone generating means of a monaural type responsive to the input means for generating a monaural tone signal having the designated tone pitch, distributing means for distributing the monaural tone signal selectively to a plurality of range channels assigned to different tone pitch ranges, a plurality of stereophonic means provided in the respective range channels for processing the distributed monaural tone signal to impart thereto stereophonic spread and location in different manners associated with the different tone pitch ranges, and output sound means connected to the range channels for producing the musical sound having the imparted stereophonic spread and location.

In the present electronic musical instrument, originally the monaural tone signal is generated according to the designated tone pitch. The monaural tone signal is distributed selectively to one of the stereo means according to its tone pitch range. The stereo means imparts to the distributed monaural tone signal the stereophonic spread and location dependent on the tone pitch. Consequently, the instrument can produce a stereophonic musical sound having a natural acoustic image with different spread and location according to the tone pitch. For example, the plurality of a stereo means are arranged such that the wider spread is imparted to the lower pitch tone so as to simulate an acoustic field of an acoustic piano.

DETAILED DESCRIPTION OF EMBODIMENTS

Figure 1:
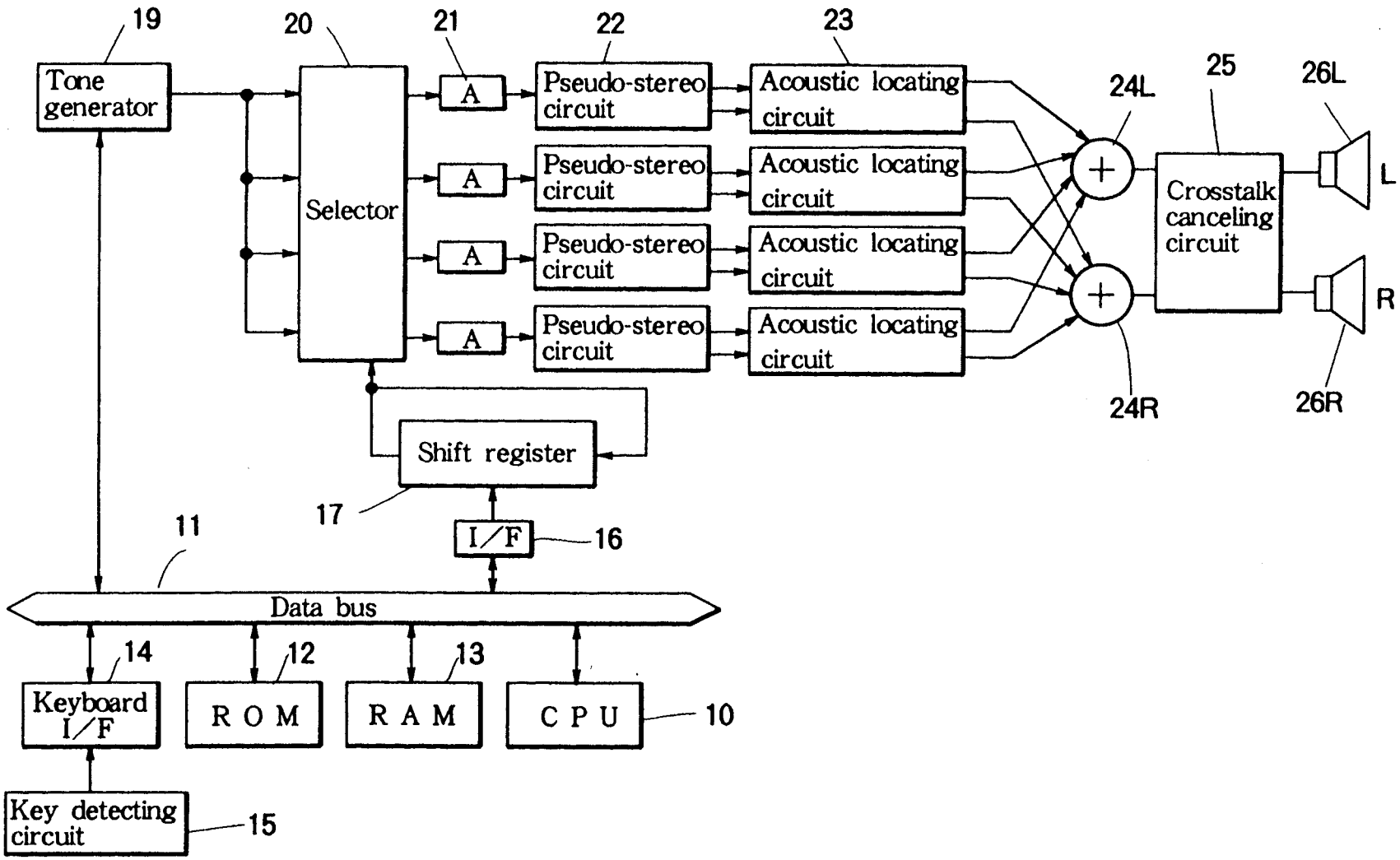
FIG. 1 is a block diagram showing one embodiment of the electronic musical instrument according to the present invention.

FIG. 1 is a block diagram showing one embodiment of the electronic musical instrument according to the present invention. The instrument is provided with a keyboard (not shown) manually operable to input performance information which includes a key code or a tone pitch, as well as key depression/release events and key touch. The instrument outputs a stereophonic musical sound through a pair of left and right sound channels (hereinafter, the letter "L" refers to the left sound channel, and the letter "R" refers to the right sound channel). The outputted musical sound is imparted with desired stereophonic spread and location dependent on the tone pitch designated by means of the keyboard.

The instrument is controlled by a CPU 10 . The CPU 10 is coupled through a data bus 11 to a ROM 12, a RAM 13, a keyboard interface 14, another interface 16 and a tone generator 19. The ROM 12 stores a program for use in controlling the electronic musical instrument, and also stores a range channel assignment table. The RAM 13 is set with various registers. The keyboard interface 14 is coupled to a key detecting circuit 15 which detects key depression and release events on the keyboard (not shown) during the course of a musical performance. The keyboard interface 14 feeds detection results of the key depression/release events to the CPU 10 . The tone generator 19 generates a monaural tone signal tuned according to key code data supplied from the keyboard interface 14. The monaural tone generator 19 is provided with, illustratively, 32 tone channels, each of which stores a single waveform sampled to generate a monaural tone signal of a desired pitch. The 32 tone channels are operated in a time-sharing (multiplexing) manner to successively output the tone signals.

The instrument further includes distributing means comprised of a selector 20 and a shift register 17, for distributing the generated monaural tone signal to 4 range channels assigned to four different pitch ranges. Each range channel is provided with a corresponding stereophonic means comprised of an accumulator (A) 21, a pseudo-stereo circuit 22 and an acoustic locating circuit 23, for processing the distributed monaural tone signal to impart thereto certain spread and location characteristics of an acoustic image, i.e., stereophonic spread and location. Specifically, the accumulator 21 accumulates amplitudes of two or more monaural tone signals when they are distributed concurrently to the same range channel. The pseudo-stereo circuit 22 or acoustic spread means imparts the stereophonic spread or wideness to the monaural tone signal. The acoustic locating circuit 23 locates the acoustic image of the tone signal. At the output stage of the instrument, an output sound system is connected to the four range channels, and is comprised of a pair of adders 24L, 24R, a crosstalk canceling circuit 25 and a pair of speakers 26L, 26R.

Figure 3A:
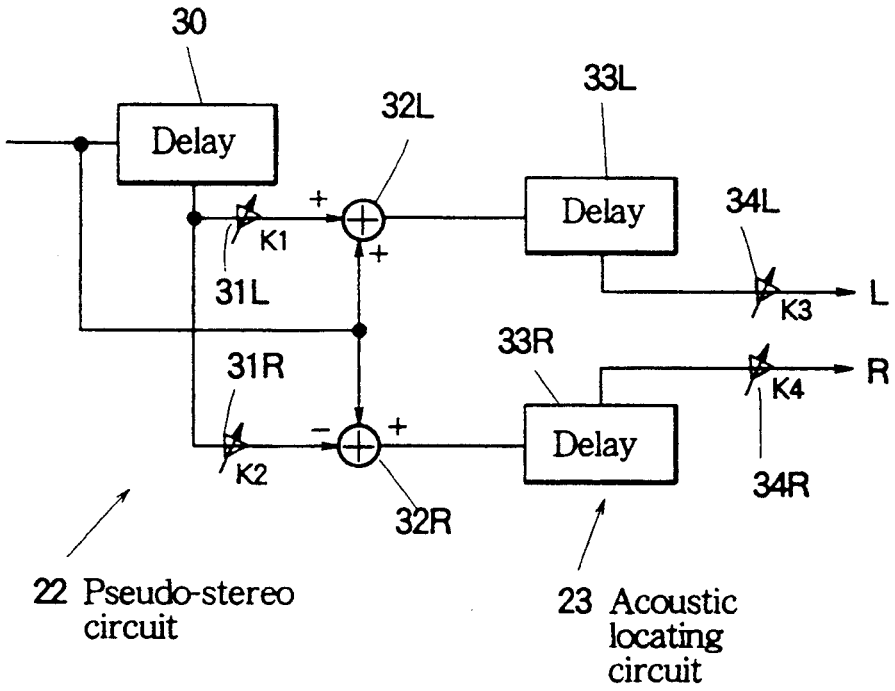
FIG. 3A is a circuit diagram showing construction of a pseudo-stereo circuit and an acoustic locating circuit, provided in the electronic musical instrument.

FIG. 3A exemplifies a combination of the pseudo-stereo circuit 22 and the acoustic locating circuit 23. The pseudo-stereo circuit 22 is comprised of a delay element 30, a pair of left and right amplifiers 31 L, 31R and a pair of left and right adders 32L, 32R. The delay element 30 delays the tone signal, fed from the tone generator 19 through the selector 20, by a certain amount of time of e.g., 2–4 ms. The output the delay element 30 is divided into left and right sound channels, and the separated signals are amplified by the respective amplifiers 31L, 31R, independently from each other by respective gains k1, k2. Then, the adder 32L of the left sound channel adds the output of the amplifier 31L with the initial tone signal. Likewise, the other adder 32R of the right sound channel adds an inverted signal from the output from the amplifier 31R with the initial tone signal.

Figure 3B:
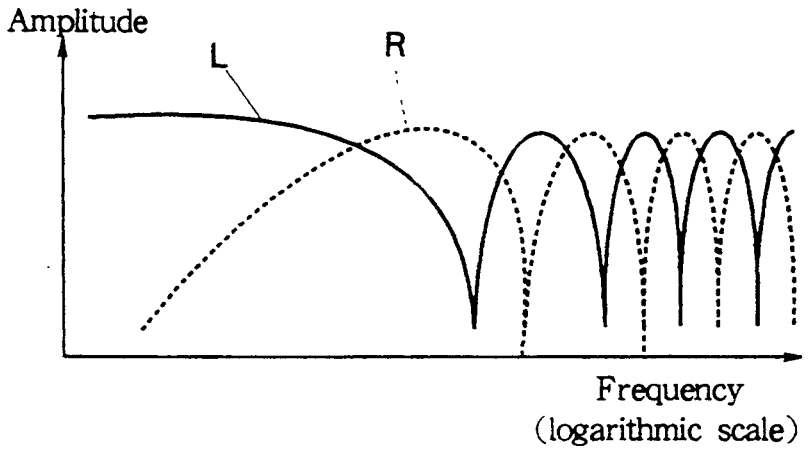
FIG. 3B is a graph showing an amplitude/frequency characteristic of the pseudo-stereo circuit.

As shown in FIG. 3B, by such a construction of the pseudostereo circuit 22, the adder 32L of the left sound channel produces a left stereophonic tone signal (L) containing harmonic components according to a comb-filtering operation. In a similar manner, the adder 32R of the right sound channel produces a right stereophonic tone signal (R) which contains harmonic components according to a comb-filtering operation. The pair of left and right stereophonic tone signals are complementary to each other, and have certain broad acoustic images.

Returning to FIG. 3A, the subsequent acoustic locating circuit 23 is comprised of a pair of left and right delay elements 33L, 33R, and a pair of left and right amplifiers 34L, 34R. The delay elements 33L, 33R delay the left and right stereophonic tone signals, respectively, by certain delay times. The amplifiers 34L and 34R amplify the respective delayed signals by given gains k3 and k4, respectively. The delay times of the delay elements 33L, 33R are suitably adjusted to impart a certain direction feature of the acoustic image to the left and right tone signals. The gains k3 and k4 of the amplifiers 34L and 34R are also suitably adjusted to impart a distance feature of the acoustic image to the left and right tone signals. Thus, the pair of stereophonic tone signals are located suitably in a stereophonic manner.

Figures 2A, 2B:
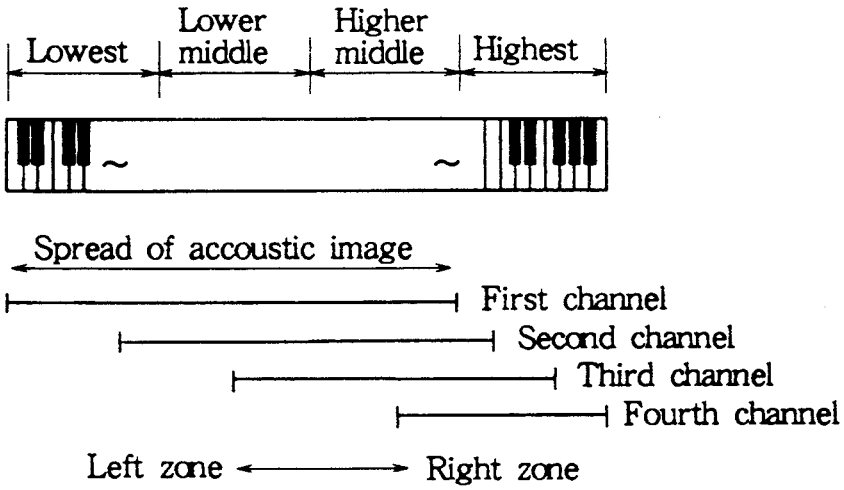
FIG. 2A is an illustrative diagram showing a scheme for forming an acoustic image according to the invention.
FIG. 2B is a table diagram showing assignment of range channels to different tone pitch ranges according to the invention.

Returning to FIG. 1, as mentioned before, the instrument is provided with the four range channels. As shown in FIG. 2A, the four range channels are assigned, respectively, to lowest pitch range, lower middle pitch range, higher middle pitch range and highest pitch range. Further, the respective range channels operate to locate the acoustic images of the corresponding distributed tone signals, as indicated in FIG. 2A. Namely, lower pitch tones are located broadly or widely in a left zone, while higher pitch tones are located narrowly in a right zone. Stated another way, the higher the tone pitch range, the narrower the spread of the acoustic image; the higher the tone pitch range, the more rightwardly is the location of the acoustic image. Such an arrangement simulates an acoustic grand piano in which the originally generated tones are resonated by a vibration plate to thereby spread in a variable manner dependent on tile tone pitch. In order to realize such a spread and location of the acoustic image, the delay elements 30, 33L and 33R ((FIG. 3A) are set with different delay characteristics for the respective range channels. Further, the amplifiers 31 L, 31 R, 34L and 34R are set with different gains for each of the range channels. FIG. 2B shows one example of the assignment of the four range channels to key codes.

Returning again to FIG. 1, the tone generator 19 inputs the initial tone signal into the selector 20. The selector 20 distributes the tone signal to one of the four range channels according to the pitch of the tone. In this operation, the shift register 17 feeds to tile selector 20 channel select data indicative of which range channel should be assigned to the inputted tone signal. The CPU 10 inputs the channel select data to the shift register 17 through the interface 16. When the key detecting circuit 15 detects a key depression, the CPU 10 designates one of the tone channels within the tone generator 19 for generating a tone signal. Concurrently, the CPU 10 sets channel select data corresponding to the key code of the depressed key into the shift register 17 in a given sequence accordingly the shift register 17 can feed the matched channel select data to the selector 20 in coincidence with the multiplex timing when the designated tone channel of tile tone generator 19 generates that tone signal.

Figure 4:
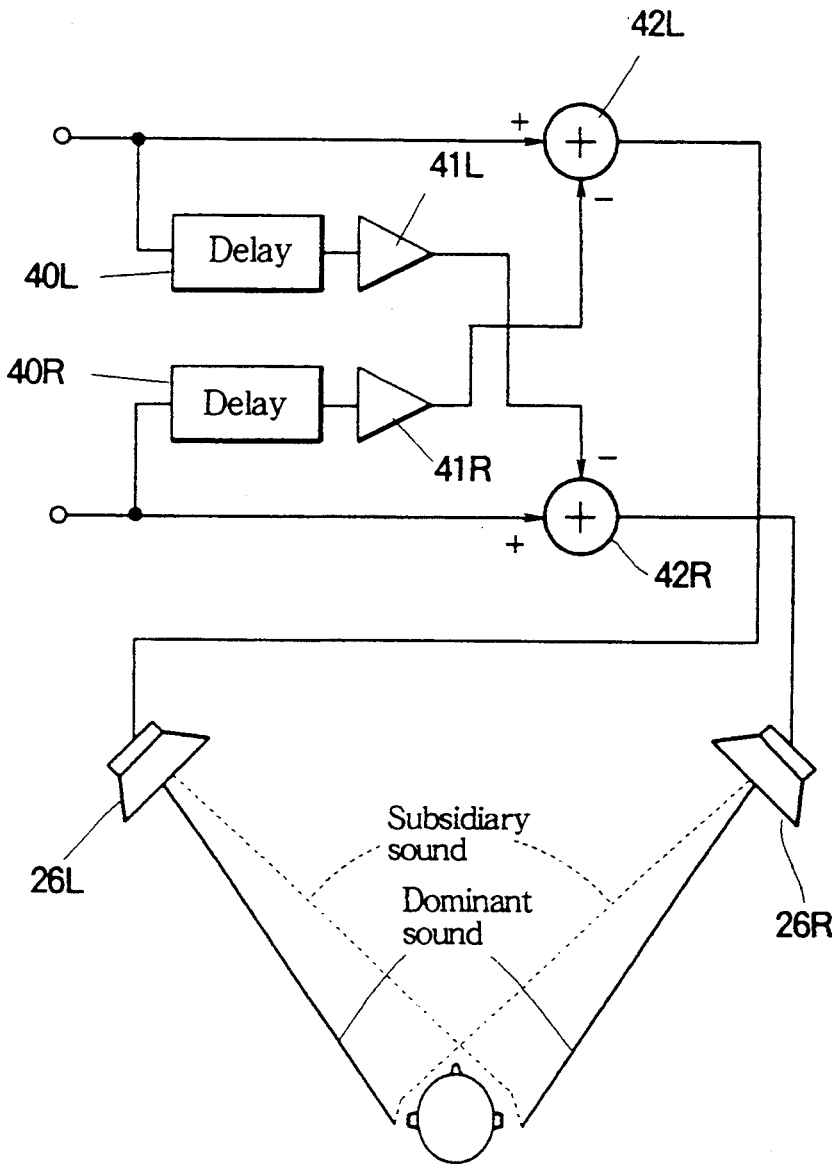
FIG. 4 is a circuit diagram showing a crosstalk canceling circuit provided in the electronic musical instrument.

As mentioned before, the tone signals outputted from the respective range channels are added by the adders 24L and 24R, separately for the left and right sound channels. The added results of the left and right sound channels are concurrently inputted into the crosstalk canceling circuit 25. FIG. 4 shows a detailed construction of the crosstalk canceling circuit 25. This circuit 25 operates to compensate for crosstalk. The location of the acoustic image is made vague when the left and right channel speakers 26L, 26R emit the musical sounds concurrently. That is, when the left and right speakers 26L, 26R concurrently emit the musical sounds, one ear of the listener receives not only a dominant sound from the front speaker, but also a subsidiary sound from behind speaker to thereby cause crosstalk such as to render vague the location of the acoustic image determined by the phase and amplitude difference between the left and right sound channels. In view of this, the crosstalk is canceled in this embodiment by emitting from the front speaker a compensative tone wave having the opposite phase to the subsidiary tone wave emitted from the behind speaker. Specifically, the left channel tone signal is delayed b3: one delay element 4()L, and is then attenuated by an amplifier 41L. An adder 42R adds an inverted one of the delayed and attenuated tone signal to the right channel tone signal. The delay element 40L introduces a given time delay corresponding to a difference between one time interval during which the subsidiary tone travels from the left speaker 26L to the right ear, and another time interval during which the dominant tone containing the compensative tone travels from the right speaker 26R to the same right car. The amplifier 41L introduces a given attenuation amount corresponding to the attenuation degree of the left channel sound when the same is deflectively turned toward the right ear. In similar manner, the right channel tone signal is delayed by a delay element 40R, and is then attenuated by an amplifier 41R. The delayed and attenuated result is subtracted from the left channel tone signal by an adder 42L. By such an operation, the dominant sound contains the compensative sound which has the same level but the opposite phase to the subsidiary sound, and which reaches the listener's ear concurrently with the subsidiary sound to thereby cancel out the same.

Figure 5:
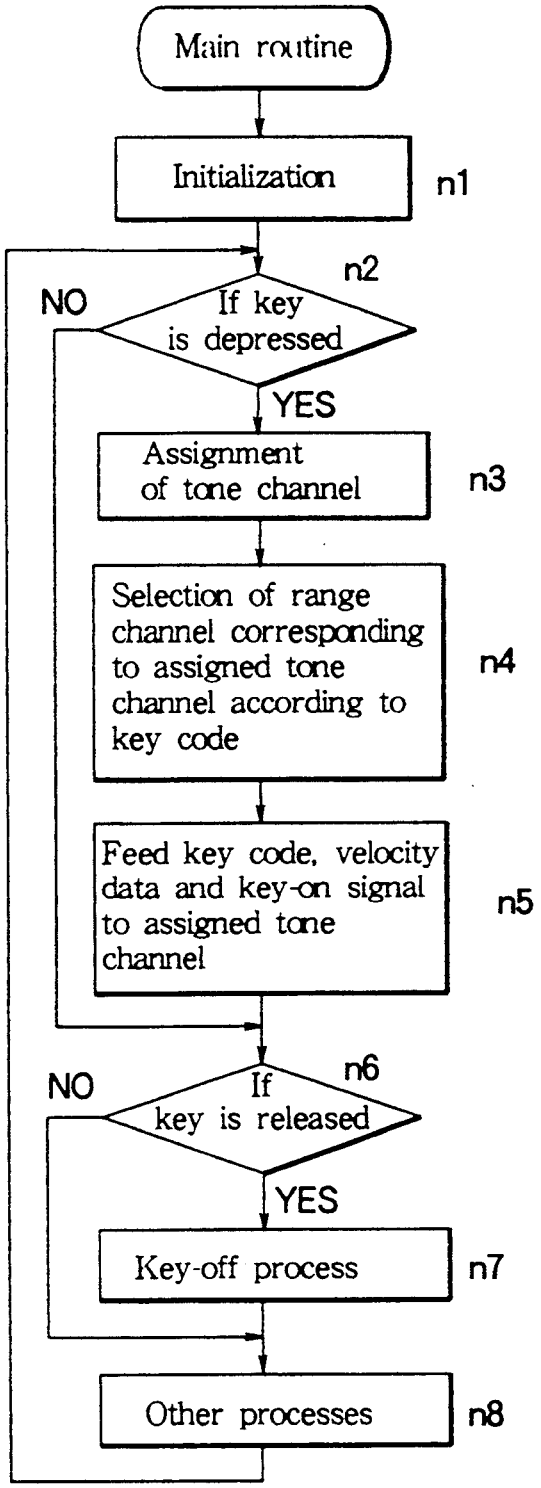
FIG. 5 is a flowchart showing operation of the electronic musical instrument according to the present invention.

FIG. 5 is a flowchart showing the operation of the FIG. 1 electronic musical instrument. In Step n1, initialization is carried out when a power source is turned on. The initialization is carried out such as to reset various registers and to feed preset timbre data to the tone generator 19. Then, Step n2 is undertaken to check if key depression occurs. In the case that a key is not depressed, processing jumps to Step n6. On the other hand, if a key is depressed, subsequent Step n3 is undertaken to assign one tone channel to generate a musical tone corresponding to the depressed key. Then, Step n4 is undertaken to retrieve from the channel assignment table (FIG. 2B) channel select data corresponding to the key code (tone pitch) of the inputted tone, and to write the retrieved channel select data into an address of the shift register 17 (in a matched manner to the assigned tone channel). Namely, the shift register 17 is set such that the channel select data is sequentially outputted to select the range channels corresponding to actuation of the tone channels which time-sequentially generate musical tone signals. The shift register 17 is operated in response to a given system clock signal to output the channel select data in synchronization with the .actuation of the tone generator 19. Then, Step n5 is undertaken to feed to the assigned tone channel various data including the key code, velocity data and key-on signal to thereby generate the musical tone signal. Thereafter, check is made in Step n6 to determine if key release has occurred. In the case that a key has been released, Step n7 is undertaken to carry out a key-off process. In this key-off process, a key-off signal is fed to the corresponding tone channel of the tone generator 19, while the corresponding channel select data stored in the shift register 17 is reset. Thereafter, Step n8 is undertaken to execute other processes, such as the master volume controlling process. The foregoing main routine is repeatedly executed to thereby continuously produce a musical sound during the course of a performance. By such an operation, spread and location of the acoustic image can be varied according to the tone pitch of the musical sound, while using a monaural tone generator.

Figure 6:
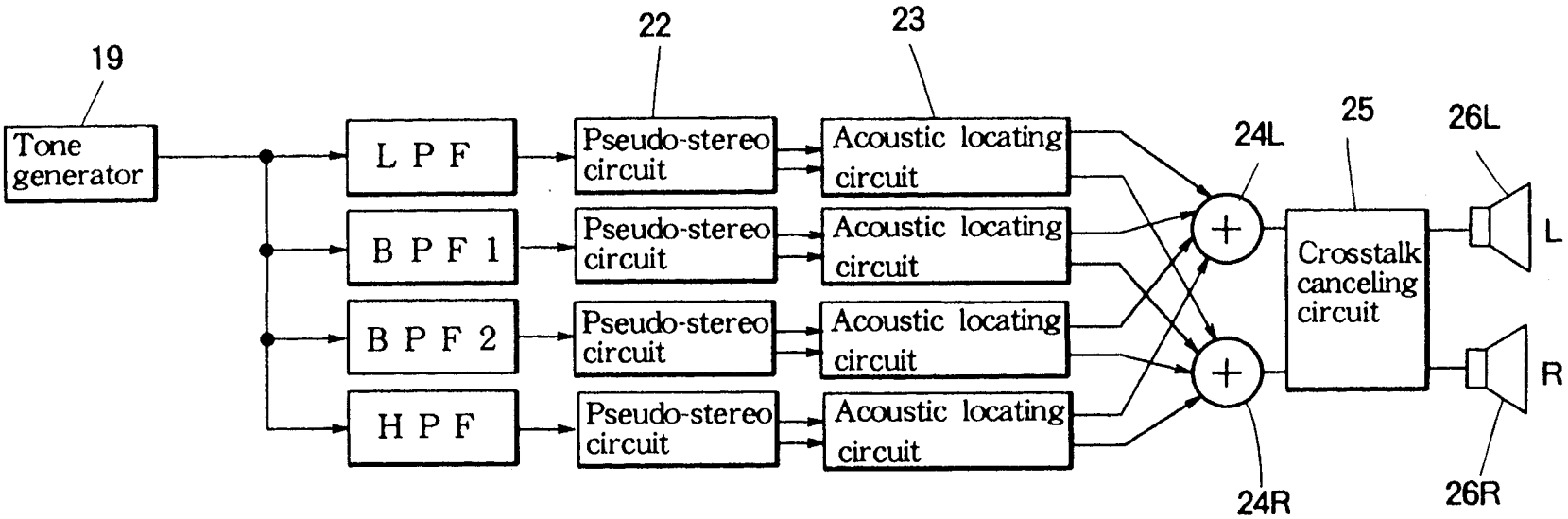
FIG. 6 is a block diagram showing another embodiment of the electronic musical instrument according to the present invention.

FIG. 6 shows another embodiment of an electronic musical instrument according to the present invention. This embodiment has a construction similar to the FIG. 1 embodiment, and therefore the same reference numbers are used for the same component. The difference is that this embodiment utilizes filters as tile distributing means in place of the selector of the FIG. 1 embodiment (where the distribution of the tone signal to the range channels is controlled according to the key code inputted by the keyboard). On the other hand, in this embodiment, the tone generator 19 is connected a parallel manner to drive a low-pass filter LPF, lower band-pass filter BPF1, higher band-pass filter BPF2 and high-pass filter tlPF. The low-pass filter LPF is coupled in series to the first range channel assigned to the lowest pitch range or frequency range. In a similar manner, the lower band-pass filter BPF1 is coupled to the second range channel assigned to the lower middle pitch range. The higher band-pass filter BPF2 is coupled to the third range channel assigned to the higher middle pitch range. The high-pass filter HPF is coupled to the fourth range channel assigned to the highest pitch range. The generated tone signal is filtered differently by these four filters LPF, BPF1, BPF2 and HPF such that the respective filtered tone signal components are distributed to the corresponding range channels. By such a construction, the spread and location of the acoustic image can be varied for each of the separated frequency components of the monaural tone signal. Four range channels are installed in the disclosed embodiments; however, more range channels or less range channels may be adopted according to the invention.

As described above, according to the invention, the tone signal generated from the monaural tone generator is distributed to a plurality of range channels assigned to different pitch ranges, where different spread and location of the acoustic image is realized dependent on the pitch range, thereby producing an acoustic field fully simulative of a natural musical instrument. Further, the monaural tone generator can reduce the capacity of the waveform memory by half, and can double the number of tone channels, as compared to a stereophonic tone generator.

What is claimed is:

1. An electronic musical instrument comprising:

input means for inputting performance information which designates a tone pitch of a musical sound to be produced during the course of performance;

tone generating means of a monaural type responsive to the input means for generating a monaural tone signal having the designated tone pitch;

distributing means for selectively distributing the monaural tone signal in accordance with tone pitch ranges;

a plurality of range channels for processing the monaural tone signal to impart thereto stereophonic spread and location in different manners associated with the different tone pitch ranges; and output sound means coupled to the range channels for producing the musical sound having the imparted stereophonic spread and location.

2. An electronic musical instrument according to claim 1, wherein the distributing means comprises selecting means coupled between the tone generating means and the respective range channels for selectively distributing the monaural tone signal to one of the range channels according to the designated tone pitch of the monaural tone signal.

3. An electronic musical instrument according to claim 1, wherein the distributing means comprises a plurality of filter means coupled between the tone generating means and the respective range channels, each filter means having a different frequency characteristic associated with the tone pitch range of the corresponding range channel for selectively filtering the monaural tone signal.

4. An electronic musical instrument according to claim 1, wherein each range channel comprises a pseudo-stereo circuit for imparting the stereophonic spread to the monaural tone signal, and an acoustic locating circuit for imparting the stereophonic location to an output of the pseudo-stereo circuit.

5. An electronic musical instrument according to claim 4, wherein the pseudo-stereo circuit comprises a comb filter for introducing harmonic components to the monaural tone signal to thereby impart the stereophonic spread.

6. An electronic musical instrument according to claim 4, wherein the acoustic locating circuit comprises a delay element for delaying the output of the pseudo-stereo circuit to determine a desired direction feature, and an amplifier for amplifying an output of the delay element to determine a desired distance feature to thereby achieve stereophonic location of the output.

7. An electronic musical instrument according to claim 1, wherein the output sound means includes a pair of left and right sound channels for producing the musical sound, and a canceling circuit coupled across the left and right sound channels for canceling out crosstalk otherwise contained in the musical sound.

8. An electronic musical instrument comprising:

tone pitch designating means for designating a tone pitch of a musical sound to be produced;

tone generating means for generating a monaural tone signal tuned according to the designated tone pitch;

acoustic spread means for imparting a stereophonic spread to the monaural tone signal according to the designated tone pitch, said acoustic spread means providing separate output signals;

acoustic locating means for imparting direction and distance features to the separate output signals according to the designated tone pitch, said acoustic locating means providing localized output signals; and output sound means, responsive to the localized signals, for producing a stereophonic musical sound.

9. An electronic musical instrument according to claim 8 including a plurality of acoustic spread means assigned to different tone pitch ranges for imparting different acoustic spreads according to the assigned tone pitch ranges, and distributing means for selectively distributing the monaural tone signal to the plurality of the acoustic spread means according to the designated tone pitch.

10. An electronic musical instrument according to claim 8, wherein the output sound means includes a pair of left and right sound channels for producing the stereophonic musical sound, and canceling means coupled across the left and right sound channels for canceling out crosstalk otherwise contained in the stereophonic musical sound.

11. An electronic musical instrument comprising:

tone pitch designating means for designating a tone pitch of a musical sound to be produced;

tone generating means for generating a tone signal tuned according to the designated tone pitch;

filter means for filtering the generated tone signal to separate the same into a plurality of tone signal components having different frequency ranges;

acoustic spread means for imparting varying stereophonic spreads to the respective tone signal components according to the different frequency ranges;

acoustic locating means for stereophonically locating tone signal components outputted from the acoustic spread means in a variable manner according to the different frequency ranges; and output sound means, driven by signals supplied from the acoustic locating means,for producing a stereophonic musical sound.

12. An electronic musical instrument according to claim 11, wherein the output sound means includes a pair of left and right sound channels for producing the stereophonic musical sound, and canceling means coupled across the left and right sound channels for canceling out crosstalk otherwise contained in the stereophonic musical sound.

13. A stereophonic function imparting circuit for an electronic musical instrument comprising:

a key detecting circuit which determines if a key is actuated;

a tone generator which generates a monaural tone signal having a pitch corresponding to an actuated key;

a selector circuit, coupled to the tone generator, which outputs the monaural tone signal in a selected one of a plurality of pitch ranges, the selected pitch range being determined by the pitch corresponding to the actuated key; and a plurality of range channels, one for each of the pitch ranges, coupled to the selector circuit to impart to the monaural tone signal in the selected pitch range stereophonic characteristics determined by the selected pitch ranges.

14. A circuit according to claim 13, wherein the selector circuit comprises a plurality of filters, each having frequency characteristics associates with a corresponding one of the plurality of pitch ranges.

15. A circuit according to claim 13, wherein the stereophonic characteristics include stereophonic spread of an acoustic image for the monaural tone signal.

16. A circuit according to claim 15, wherein each of the range channels includes a comb filter to introduce harmonic components to the monaural signal to thereby impart the stereophonic spread.

17. A circuit according to claim 13, wherein the stereophonic characteristics include direction characteristics of an acoustic image for the monaural tone signal.

18. A circuit according to claim 17, wherein each of the range channels includes a time delay circuit to impart the direction characteristics.

19. A circuit according to claim 13, wherein the stereophonic characteristic include distance characteristics of an acoustic image for the monaural tone signal.

20. A circuit according to claim 19, wherein each of the range channels includes an amplifier to impart the distance characteristics.

* * * * *